US010450912B2

(12) United States Patent
Donnelly et al.

(10) Patent No.: US 10,450,912 B2
(45) Date of Patent: Oct. 22, 2019

(54) EXHAUST SILENCER

(71) Applicant: Ford Global Technologies, LLC, Dearborn, MI (US)

(72) Inventors: James Donnelly, Chelmsford (GB); Daniel Neville, Wickford (GB); John Shore, Chelmsford (GB); Graeme McKen, Billericay (GB)

(73) Assignee: Ford Global Technologies, LLC, Dearborn, MI (US)

( * ) Notice: Subject to any disclaimer, the term of this patent is extended or adjusted under 35 U.S.C. 154(b) by 308 days.

(21) Appl. No.: 15/207,427

(22) Filed: Jul. 11, 2016

(65) Prior Publication Data

US 2017/0022861 A1 Jan. 26, 2017

(30) Foreign Application Priority Data

Jul. 23, 2015 (GB) ..... 1513027.1

(51) Int. Cl.
*F01N 1/08* (2006.01)
*F01N 1/02* (2006.01)

(52) U.S. Cl.
CPC ..... *F01N 1/08* (2013.01); *F01N 1/083* (2013.01); *F01N 1/02* (2013.01); *F01N 2230/00* (2013.01); *F01N 2240/20* (2013.01); *F01N 2260/02* (2013.01); *F01N 2260/022* (2013.01); *F01N 2530/04* (2013.01); *F01N 2530/06* (2013.01); *F01N 2530/18* (2013.01)

(58) Field of Classification Search
CPC ... F01N 1/08; F01N 1/083; F01N 1/02; F01N 2230/00; F01N 2240/20; F01N 2260/02; F01N 2260/022; F01N 2530/04; F01N 2530/06; F01N 2530/18
USPC ..... 60/320
See application file for complete search history.

(56) References Cited

U.S. PATENT DOCUMENTS 3,661,529 A 5/1972 Karolidis
2007/0107982 A1 5/2007 Sullivan
(Continued)

FOREIGN PATENT DOCUMENTS

CN 2703877 Y 6/2005
CN 103982282 A 8/2014
DE 102005040052 A1 12/2006
(Continued)

OTHER PUBLICATIONS

Examination Report of Great Britain Patent Application No. 1513027.1, dated Jan. 18, 2016, 6 pages, United Kingdom Intellectual Property Office.

*Primary Examiner* — Laert Dounis
*Assistant Examiner* — Kelsey L Stanek
(74) *Attorney, Agent, or Firm* — Geoffrey Brumbaugh; McCoy Russell LLP

(57) ABSTRACT

An exhaust silencer for a motor vehicle is provided. In one example, the silencer comprises a noise-reducing structure and a heat sink to transfer heat from exhaust gases to the exterior of the silencer, the heat sink comprising two regions of fins which define a plurality of flow channels through the heat sink, the flow channels directing the flow of exhaust through the silencer from an inlet passage to an outlet passage. In this way, a temperature of the exhaust is reduced, and the silencer and downstream components of an exhaust system may be constructed of materials of a lower thermal tolerance.

21 Claims, 7 Drawing Sheets

(56) References Cited

U.S. PATENT DOCUMENTS

| | | | | |
|---|---|---|---|---|
| 2010/0307863 | A1 | 12/2010 | Van De Flier et al. | |
| 2012/0267191 | A1 * | 10/2012 | Danner | F01N 1/026 181/227 |

FOREIGN PATENT DOCUMENTS

| | | | | |
|---|---|---|---|---|
| DE | 102010054431 | A1 | 6/2012 | |
| EP | 0905355 | A2 * | 3/1999 | B01D 53/8696 |
| JP | 59147812 | A * | 8/1984 | F01N 3/02 |
| JP | S59147812 | A | 8/1984 | |
| JP | 2009133259 | A | 6/2009 | |

* cited by examiner

EXHAUST SILENCER

CROSS REFERENCE TO RELATED APPLICATION

This application claims priority to Great Britain Patent Application No. 1513027.1, filed Jul. 23, 2015, the entire contents of which are hereby incorporated by reference for all purposes.

TECHNICAL FIELD

The present disclosure relates to an exhaust silencer assembly.

BACKGROUND

Motor vehicles may be propelled by an engine, which produces high-temperature exhaust gas that is directed to atmosphere via an exhaust system. In some areas of the exhaust system, the high temperature of the exhaust gases can be beneficial. For example, the high temperature exhaust gases can heat a catalytic converter of the exhaust system to a temperature at which it operates efficiently.

The exhaust system may also include areas where the high temperature of the exhaust gases has no useful effect and/or may be harmful, such as a muffler/silencer. U. S. Patent Application No. 2007/107982 discloses a mechanism to manage excess heat in a muffler. Therein, the muffler may include a heat sink within the housing of the muffler to transfer heat from the muffler to areas external the housing, such as a fuel reformer.

However, the inventors herein have recognized an issue with the above approach. The heat extracted from the exhaust gas in the muffler via the heat sink still travels through the housing of the muffler. Thus, the muffler is constructed to withstand the high temperatures, and thus may be comprised of heavier and/or more expensive materials, and/or manufactured with construction methods that are more time consuming.

SUMMARY OF INVENTION

According to a first aspect of the present disclosure, there is provided an exhaust silencer, e.g., muffler, for a motor vehicle, wherein the silencer is configured to reduce noise, e.g., a volume of noise, emitted from an exhaust system of the motor vehicle. The silencer comprises a housing defining an exhaust inlet and an exhaust outlet, a noise reducing structure provided within the housing, and a heat sink configured to transfer heat from exhaust gases to outside the housing of the silencer. A first portion of the heat sink is arranged to be in a flow of exhaust gases within the housing and a second portion of the heat sink extends beyond an outer wall the housing. The heat sink is configured to transfer heat from the exhaust gases to outside the housing of the silencer.

The temperature of exhaust gases passing through the silencer may be reduced by the heat sink, which may transfer said heat to the exterior of the silencer housing and dissipate said heat in outside air passing over the housing. By including a heat sink that extends beyond the outer wall of the housing, the silencer may transfer heat to outside of the silencer without passing the heat through the housing. In reducing the temperature of exhaust gases and bypassing heat transfer through the housing, the silencer and other components of the exhaust system positioned downstream of the silencer may be constructed of a material which may have a lower thermal tolerance than silencers configured to withstand the high-temperature exhaust, such as a composite or polymer material. Use of these materials in place of traditional high-temperature materials may reduce the exhaust system's weight and/or cost of production.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

For a better understanding of the present disclosure, and to show more clearly how it may be carried into effect, reference will now be made, by way of example, to the accompanying drawings, in which:

FIGS. 3-7 are shown approximately to scale.

DETAILED DESCRIPTION

Figure 1:
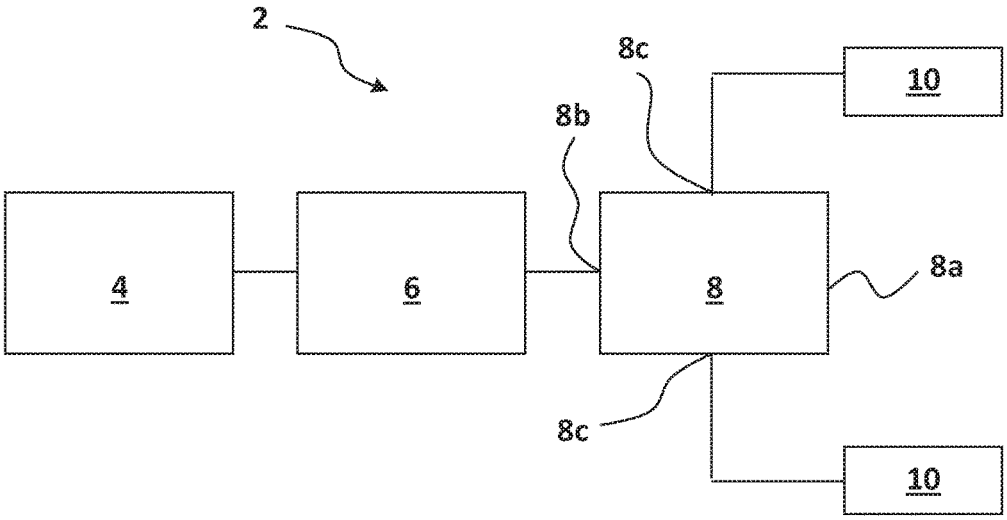
Prior Art FIG. 1
FIG. 1 is a schematic view of an engine exhaust system.

The following description relates to systems and methods for providing an exhaust silencer in an exhaust system of a motor vehicle. FIGS. 1-7 show an exhaust silencer which may pass exhaust gases discharged by an engine. Exhaust gases may enter the silencer from one or more exhaust inlet passages coupled to a passage or passages of an exhaust system, and exhaust gases may be discharged from the silencer through one or more exhaust outlet passages further coupled to a passage or passages of an exhaust system. The silencer may comprise a housing or enclosure, defining interior and exterior portions of the silencer. The silencer may further comprise one or more interior baffles which may divide the interior of the silencer into multiple chambers. The silencer may comprise one or more resonating chambers and/or regions comprising acoustic insulation for the reduction of acoustic energy produced by exhaust gases, and an exterior noise level of the exhaust system may be reduced. The silencer may further comprise a heat sink, which may comprise one or more portions in the interior of the silencer and extending to the exterior of the silencer housing, which may be thermally coupled to one another, and configured to collect heat from exhaust gases passing through the silencer and transfer said heat to the air outside the silencer housing.

The heat sink may thereby reduce the temperature of the exhaust inside the silencer, and may further provide a reduced temperature of exhaust discharged by the silencer. The heat sink may further comprise fins which facilitate thermal transfer, and may also be physically shaped and/or oriented to define channels which may direct the flow of exhaust through the silencer interior from an inlet passage to an outlet passage. Components of the silencer, such as the silencer housing, as well as components of the exhaust system downstream of the silencer, such as a tailpipe, may be constructed of a material of a lower thermal tolerance due to the reduction in exhaust gas temperature. Use of low-temperature tolerance materials, such as composite or polymer materials, may reduce the weight of components of the exhaust system.

For the description herein, an exhaust silencer may also be known as an exhaust muffler. The terms "silencer" and "muffler" may be used interchangeably.

The first portion of the heat sink may be in thermal communication with the second portion of the heat sink. However the first and second portions of the heat sink may be fluidically isolated, such that exhaust gases passing through the first portion of the heat sink are not in fluidic communication with the second portion of the heat sink.

The first portion of the heat sink may comprise one or more inlet flow channels arranged downstream of the exhaust inlet. The inlet flow channels may be passages or openings which permit passage and/or direct the flow of gases. The inlet flow channels may be configured to at least initially direct flow in the direction of the incoming exhaust from the exhaust inlet, e.g. parallel to an exhaust inlet duct, such that exhaust flowing from the exhaust inlet may flow through the inlet flow channels in the same direction. Inlet flow channels may also divert, diffuse, or otherwise direct gas flows from the exhaust inlet in one or more directions.

The first portion of the heat sink may comprise one or more outlet flow channels arranged upstream of the exhaust outlet. The outlet flow channels may be configured to direct flow in the direction of the exhaust passing through the exhaust outlet, e.g. parallel to an exhaust outlet duct. The one or more inlet flow channel or channels may be in fluidic communication with the one or more outlet flow channels.

The second portion of the heat sink may comprise one or more external flow channels configured to receive a flow of air passing over the silencer outer wall.

The first portion of the heat sink may comprise a first array of fins. The fins may extend in a first direction from a first end of the heat sink towards the housing outer wall. In other words, the first array of fins may be provided within the housing of the silencer, may be coupled to or adjacent to an outer wall of the housing, and may extend some distance into the interior of the silencer. The first array of fins may further be adjacent to and downstream of an exhaust inlet passage, and may provide inlet flow channels which are in fluidic communication with the exhaust inlet passage.

The array of fins may be configured to absorb heat from the exhaust gases. The size and/or density of the array of fins may be configured according to the power of the engine or an operating temperature of the exhaust.

The fins and/or flow channels may be configured to permit the flow of exhaust gases from the exhaust inlet of the silencer to the exhaust outlet of the silencer. The fins and/or flow channels may be configured to channel the exhaust gases from the exhaust inlet of the silencer towards the exhaust outlet of the silencer.

The fins may extend in one or more second directions, which may be perpendicular to the first direction, e.g. the fins may form plates in a plane defined by the first and second directions. Said another way, the fins may be shaped as planar or curved plates, and may be oriented in one or more directions.

The first array of fins may comprise a first region and a second region. In one embodiment, the first region may be positioned upstream of the second region, wherein the first region is positioned more closely to an exhaust inlet and the second region is positioned more closely to an exhaust outlet. The fins within the first region may extend in one or more second directions, which may be perpendicular to the first direction. The fins within the second region may extend in one or more third directions, which may be perpendicular to the first direction and may be at an angle to one or more of the second directions. Said another way, the fins of the second region may be shaped, oriented, and/or distributed differently from the fins of the first region, e.g., to redirect gas flow toward an exhaust outlet.

The fins may at least partially define one or more inlet and/or outlet channels. For example, the fins within the first region may at least partially define inlet flow channels, which may permit a flow of gas emerging from an exhaust inlet passage, and/or the fins within the second region may at least partially define the outlet flow channels, which may permit gas to flow toward an exhaust outlet passage. Said another way, heat sink fins in the silencer interior may define one or more channels through which exhaust gases may flow.

The fins within the second region may be segmented, e.g., discontinuous, in the third direction. The second region may comprise a 2-dimensional matrix of fins. The fins within the second region may comprise rods. This may allow diffusion of the exhaust gases in multiple directions within the second region of the heat sink.

The second portion of the heat sink, which may be at the silencer exterior, may comprise a second array of fins. The fins within the second array of fins may extend in a fourth direction from a second end of the heat sink towards the housing outer wall. In other words, the second array of fins may be provided outside the silencer housing.

The heat sink may further comprise a thermal mass provided between the first and second portions of the heat sink, e.g., between the first and second arrays of fins. The thermal mass may be in thermal communication with the first and/or second portions of the heat sink, allowing a transfer of heat between the portions. The heat sink may be coupled to the housing of the silencer at the thermal mass.

The fins within the second array of fins may extend in a fifth direction, perpendicular to the fourth direction, e.g., the fins may form plates in a plane defined by the fourth and fifth directions. The fifth direction may be substantially aligned with a flow of air passing over the housing of the silencer. The fins within the second array of fins may at least partially define the external flow channels.

The heat sink may be thermally insulated from the housing of the silencer.

The heat sink may be spaced apart from the exhaust inlet. Additionally or alternatively, the heat sink may be spaced apart from the exhaust outlet. Again additionally or alternatively, a first end of the heat sink first portion opposite to the heat sink second portion, may be spaced apart from the housing outer wall adjacent to the first end.

The housing of the silencer may be constructed from a composite material, a polymer material, or other suitable low-weight material. However, in some examples the housing of the silencer may be constructed from a metal or metal alloy.

According to another aspect of the present disclosure, there is provided an exhaust system or vehicle comprising the exhaust silencer according to a previously mentioned aspect of the disclosure.

An example of the present disclosure optionally includes one or more of the previous examples, and further may include an exhaust silencer comprising a housing including an exhaust inlet and one or more exhaust outlets, a plurality of noise-reducing chambers within the housing, and a heat sink positioned in one of the plurality of noise-reducing chambers and extending from within the housing to beyond an outer wall of the housing, the heat sink comprising a first set of plate-shaped fins arranged parallel to an exhaust inlet flow direction and a second set of rod-shaped fins arranged parallel to the exhaust inlet flow direction and parallel to an exhaust outlet flow direction. In one embodiment, the first set of plate-shaped fins and the second set of rod-shaped fins may be positioned within the housing, and the heat sink may comprise a third set of plate-shaped fins positioned outside the housing. The first set of plate-shaped fins may be thermally coupled to the third set of plate-shaped fins via a thermal mass.

A further example of the present disclosure optionally includes one or more of the previous examples, and further may include a system comprising an exhaust passage configured to couple to an engine, a tailpipe, and an exhaust silencer coupling the exhaust passage to the tailpipe, the exhaust silencer comprising a housing defining one or more sound-reducing chambers, the exhaust silencer further comprising a heat sink, wherein the heat sink may be partially positioned within the housing and extending outside the housing of the exhaust silencer.

FIGS. 1-7 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

With reference to FIG. 1, a prior art engine exhaust system 2 for a vehicle, e.g. a motor vehicle, may comprise an exhaust manifold 4, a catalytic converter 6, a silencer 8, and one or more tail pipes 10.

The exhaust manifold 4 may comprise a series of pipes or passages configured to collect a flow of hot exhaust gases, which is outlet by each of one or more cylinders of an engine, such as a diesel engine or a gasoline engine (not shown). The exhaust manifold 4 may be configured to converge one or more flows of exhaust gases from the respective cylinders together, e.g., into one or more combined flows of exhaust gases. When combining the flows of exhaust gases, it may be desirable to minimize disturbances to the flow, which may cause an increase in pressure at the engine cylinders.

The exhaust manifold may be configured to feed the combined exhaust gas flows into the catalytic converter 6. In the arrangement shown in FIG. 1, the exhaust manifold is configured to converge the flows of exhaust gases into a single flow to be fed into the catalytic converter. However, it is equally envisaged that the exhaust manifold 4 may be configured to converge flows of exhaust gases into two or more combined flows, which may be fed into the catalytic converter 6, two or more catalytic converters, or another device or arrangement of devices coupled to the exhaust system.

The catalytic converter 6 may be a two-way converter, configured to reduce the quantities of carbon monoxide and unburnt hydrocarbons within the exhaust gases. Alternatively, the catalytic convertor may be a three-way converter, configured to reduce the quantities of carbon monoxide, unburnt hydrocarbons and nitrogen oxides within the exhaust gases. Other exhaust gas after-treatment devices, such as a gasoline particulate filter, a diesel particulate filter, a selective catalytic reduction device, an oxidation catalyst, and/or any other after-treatment device may be provided instead of, or in addition to, the catalytic convertor.

The catalytic converter may comprise a core, e.g. a honeycomb core, which has been coated with a wash coat comprising a catalyst, such as a platinum group metal catalyst. The catalyst may be configured to catalyze an oxidation and/or reduction reaction, through which polluting species within the exhaust gases are converted into less polluting substances. The catalyst may be effective at and/or above a light-off temperature of the catalyst, at which the catalyst is able to begin effectively catalyzing reactions. It may therefore be desirable for the exhaust gases to be delivered from the exhaust manifold 4 at a high temperature, such that the catalytic converter is heated to the light-off temperature of the catalyst.

Exhaust gases passing through the catalytic converter may enter the silencer 8. As depicted in FIG. 1, the exhaust system 2 may comprise a single silencer 8. In another arrangement (not shown), the exhaust system 2 may comprise two or more silencers arranged in a cascade or parallel configuration, which receive a flow of exhaust gas from one, two, or more catalytic converters or other upstream components passing a flow of exhaust through the exhaust system.

The silencer 8 may comprise a housing 8*a*, which defines one or more exhaust inlets 8*b* and one or more exhaust outlets 8*c*. The silencer may be configured to reduce the magnitude of pressure variations in the exhaust gases that may otherwise be converted to sound when the exhaust gases exit the exhaust system 2 at the tailpipes 10.

In order to reduce the pressure variation magnitudes, the silencer 8 may comprise one or more baffle plates (not shown), provided within the housing 8*a*, which define one or more resonating chambers. The resonating chambers may be configured to produce pressure waves, which destructively interfere with the pressure variations within the exhaust gases, reducing the magnitude of the pressure variations.

Additionally or alternatively, the silencer housing 8*a* may comprise one or more passages or chambers (not shown) comprising a sound deadening material, such as fiberglass, configured to dampen the pressure variations within the exhaust gases. The passages or chambers comprising a sound deadening material may be in fluidic communication with the exhaust inlet and/or outlet. Additionally or alternatively, the silencer 8 may comprise one or more other sound deadening structures.

The silencer may be configured to reduce the magnitude of all pressure variations within the exhaust gases. Alternatively, the silencer may be configured to reduce the magnitude of pressure variations within a certain frequency range. The silencer may therefore reduce a volume of noise produced at the tail pipe 10 of the exhaust system. Additionally or alternatively, the silencer may change, e.g., reduce, the frequency of noise produced by the exhaust system, or alter the balance of a spectrum of frequencies produced therein.

The silencer 8 and the tail pipes 10 may be constructed from a material which has been selected to withstand the high temperature of the exhaust gases passing through the exhaust system 2. For example, the silencer 8 and the tail pipes 10 may be constructed from steel. The method of construction used may also be selected to be appropriate for the high temperature gases. For example, sections of the tail pipes may be welded together.

Figure 2:
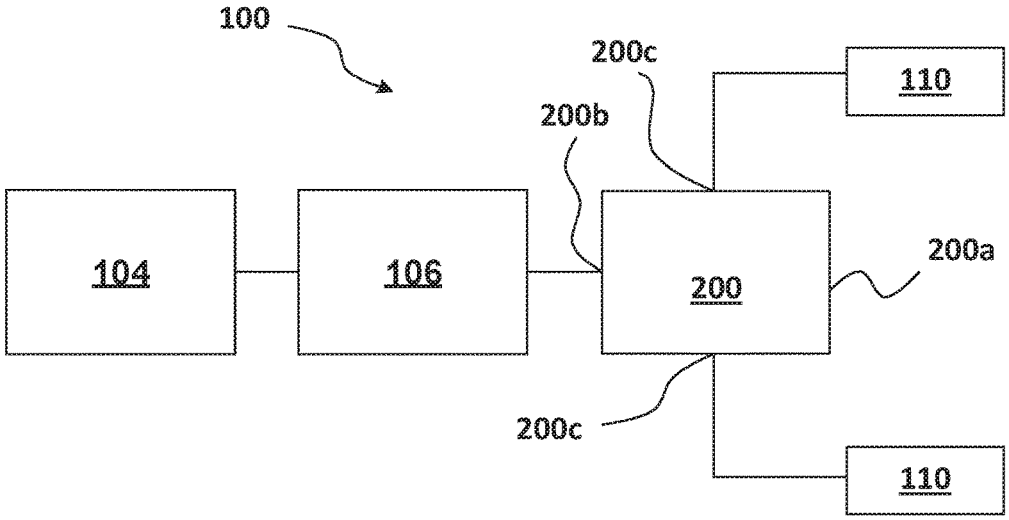
FIG. 2 is a schematic view of an engine exhaust system, according to arrangements of the present disclosure.

With reference to FIG. 2, an exhaust system 100 according to an arrangement of the present disclosure may comprise an exhaust manifold 104, a catalytic converter 106, a silencer 200, and one or more tailpipes 110. In one embodiment, the exhaust manifold 104 may be configured similarly to exhaust manifold 4, and the catalytic converter 106 may be similarly configured to catalytic converter 6 of FIG. 1.

The silencer 200 may comprise a housing 200*a*, which may be constructed from a composite material, such as carbon fiber or glass fiber, or a polymer material. In other examples, the housing may be constructed from a metal or metal alloy. The silencer may further comprise one or more exhaust inlets 200*b* and one or more exhaust outlets 200*c*, which may extend as a walled passage, pipe, or conduit into the housing 200*a*, e.g. with a portion of the inlet and/or outlet passageway being located within the housing interior. The one or more inlets 200*b* and/or outlets 200*c* may extend into the silencer housing through a hole or port, which may be sealed, bonded, and/or welded to secure the inlet and/or outlet to the housing. In other embodiments, inlets 200*b* and/or outlets 200*c* may be connected to a connector or fitting on the silencer housing 200*a*. In some embodiments, inlets 200*b* and/or outlets 200*c* may be thermally insulated from the housing 200*a*. An exhaust inlet 200*b* may have a width 252, and may extend into the interior of the housing 200*a* by a distance 256. An exhaust outlet 200*c* may have a width 254, and may extend into the interior of the housing 200*a* by a distance 258. Additionally or alternatively, an exhaust inlet 200*b* or exhaust outlet 200*c* may extend past a baffle plate 202 by a distance such as distance 262.

Figure 3:
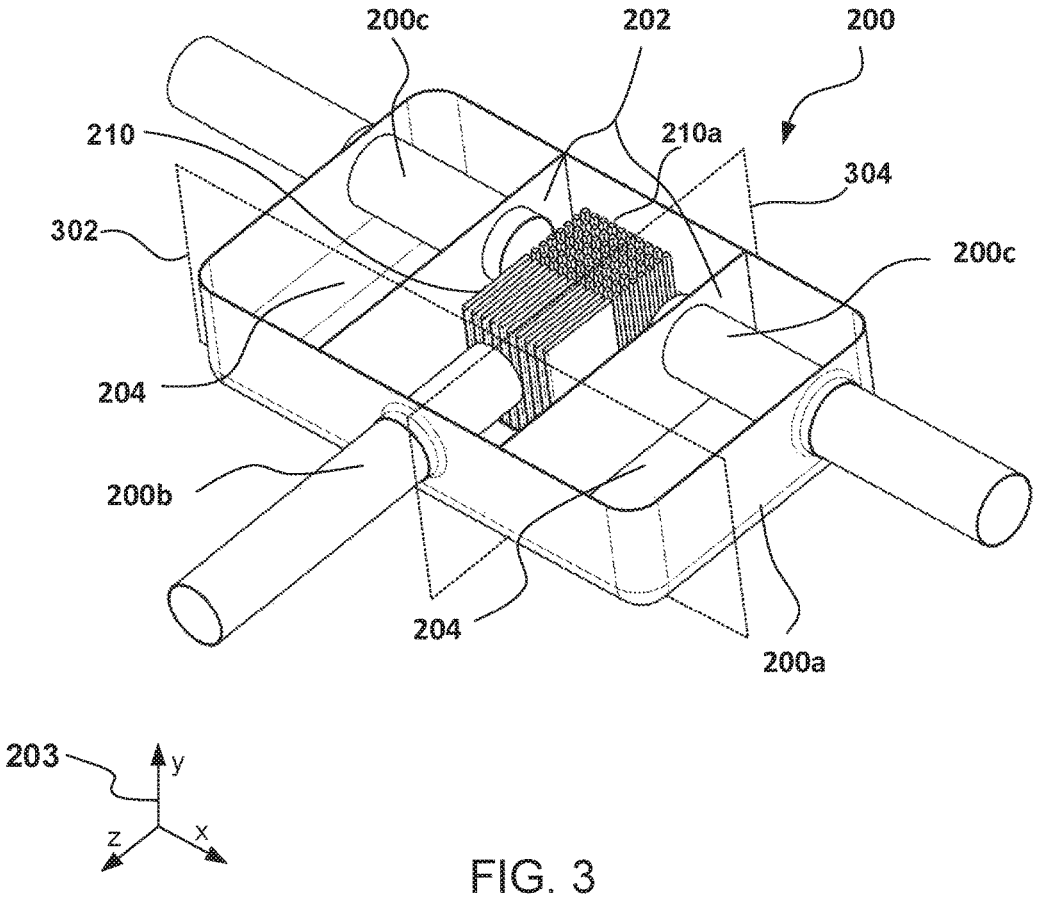
FIG. 3 is a perspective view of an exhaust silencer assembly, according to an arrangement of the present disclosure.
Figure 4:
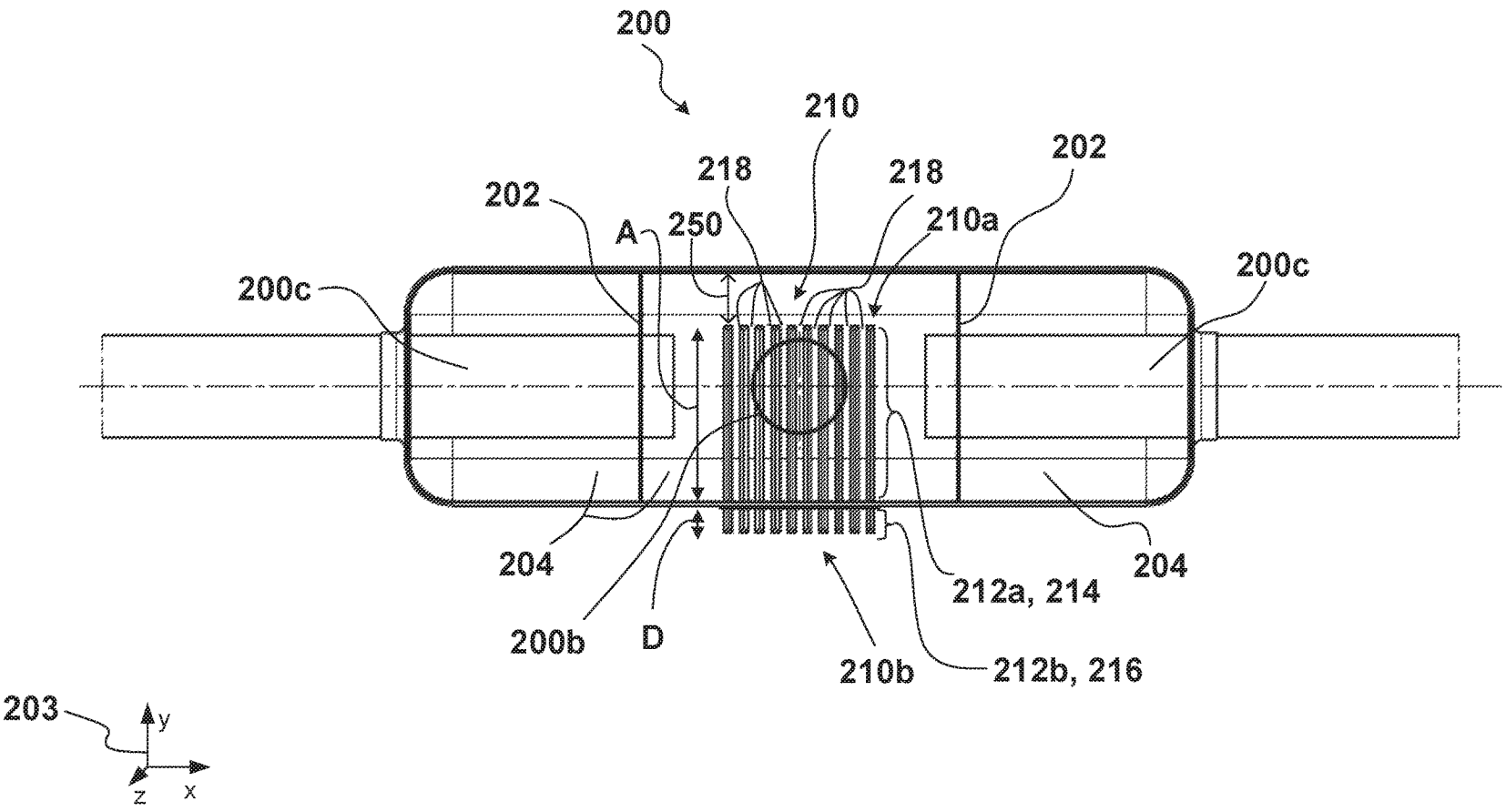
FIG. 4 is a cross-sectional view of the exhaust silencer assembly, according to an arrangement of the present disclosure.
Figure 5:
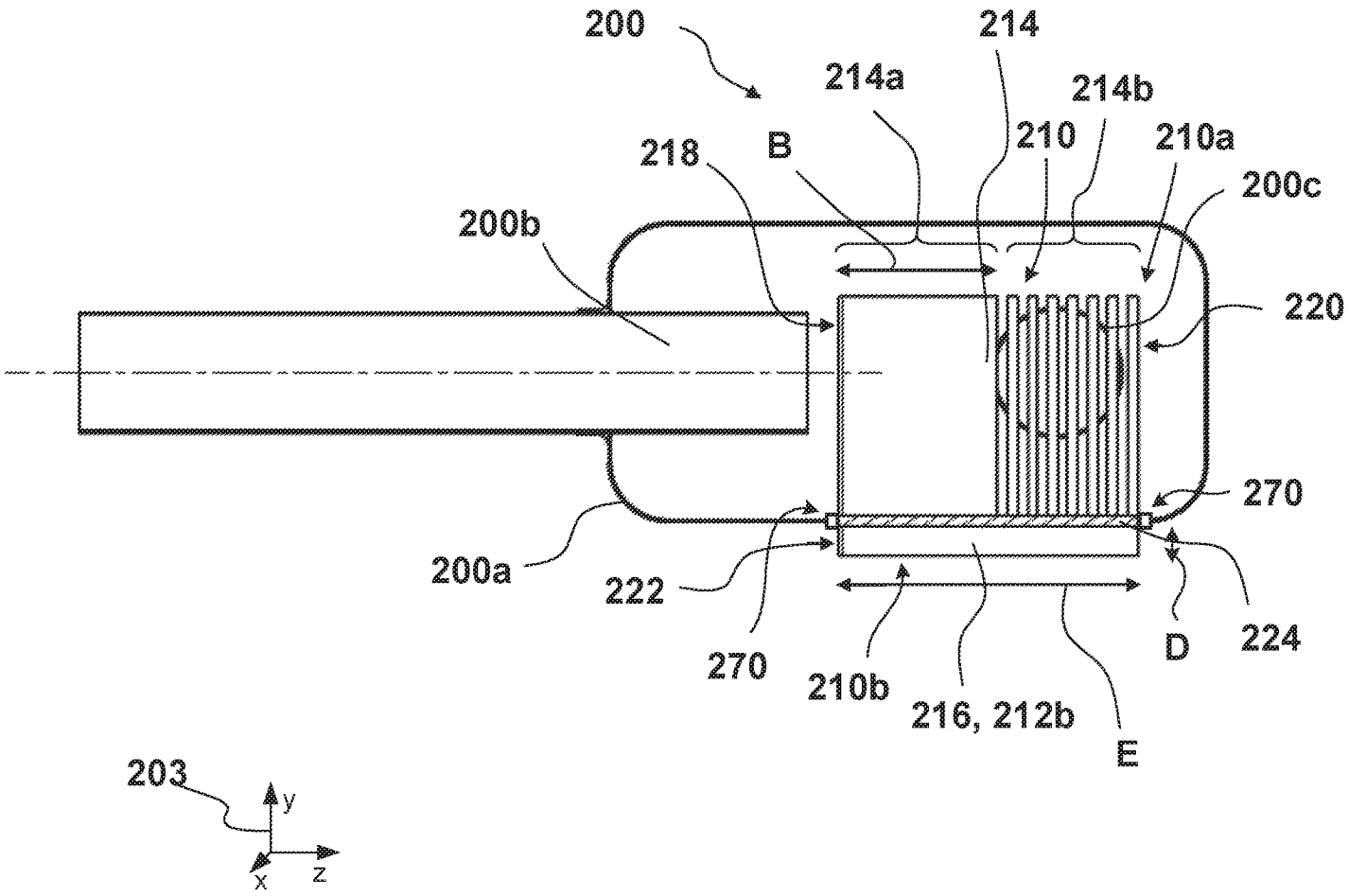
FIG. 5 is another cross-sectional view of the exhaust silencer assembly, according to an arrangement of the present disclosure.
Figure 6A:
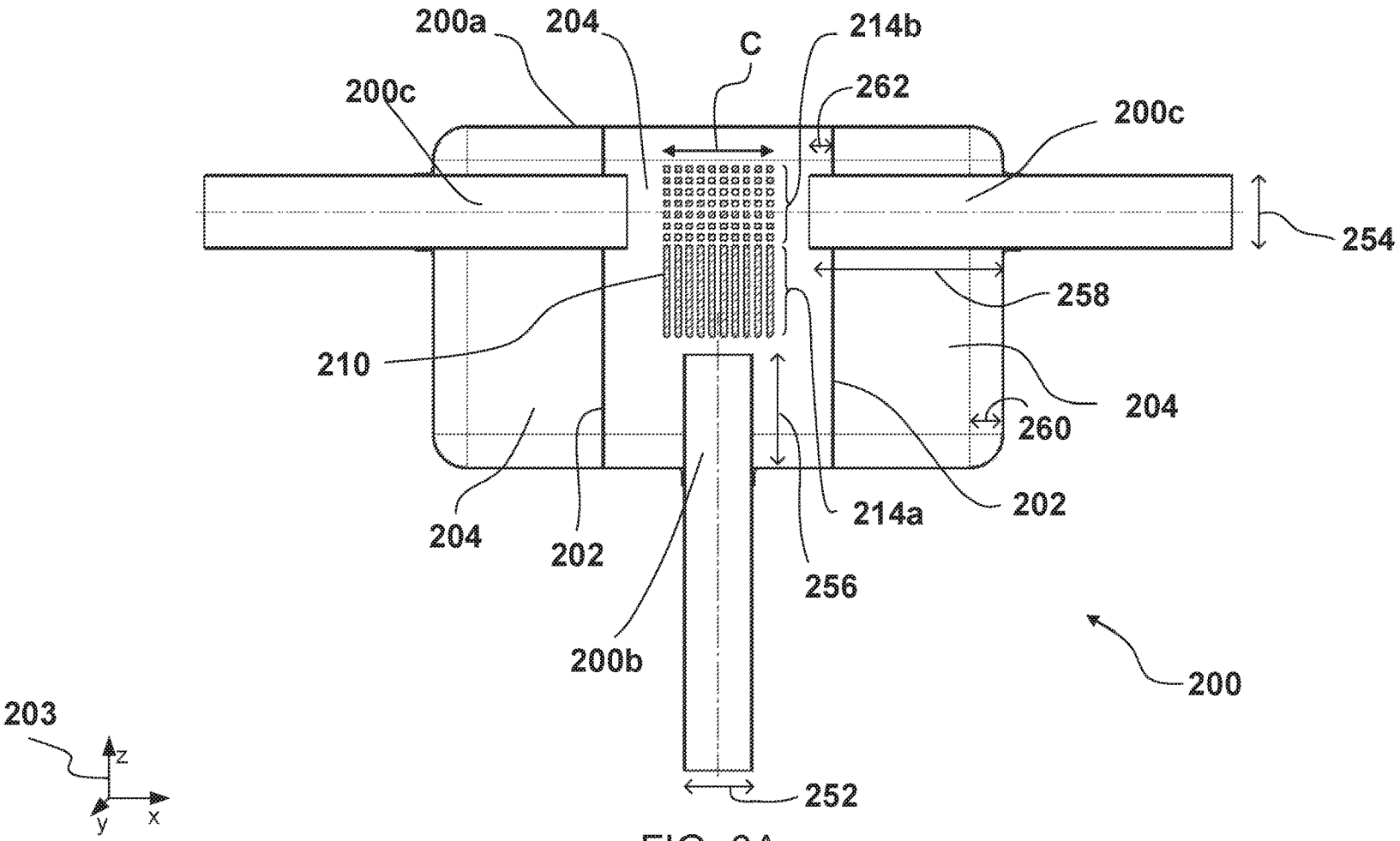
FIG. 6A is a top view of the exhaust silencer assembly, according to an arrangement of the present disclosure.
Figure 6B:
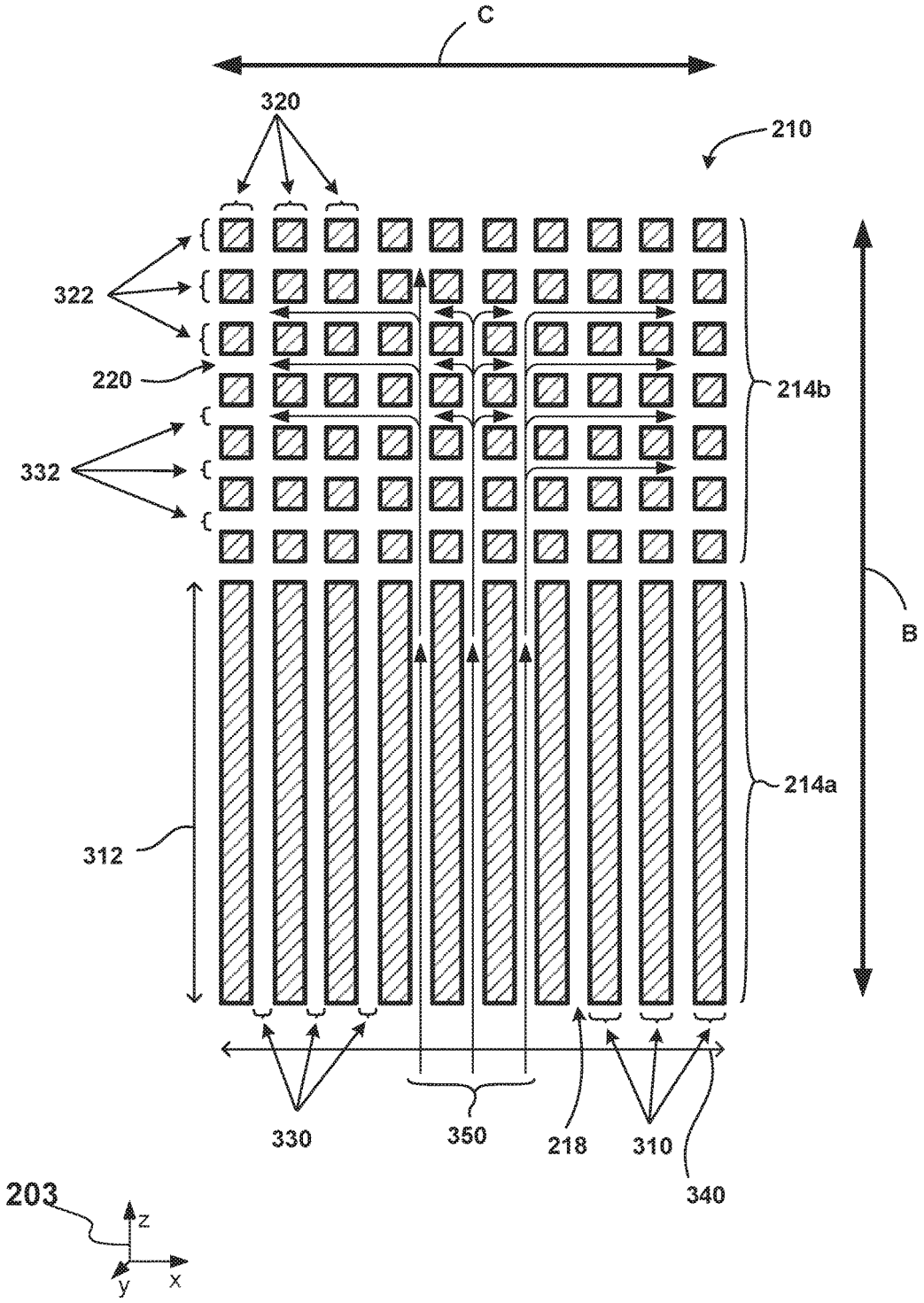
FIG. 6B is a top view of a heat sink, according to an arrangement of the present disclosure.
Figure 7:
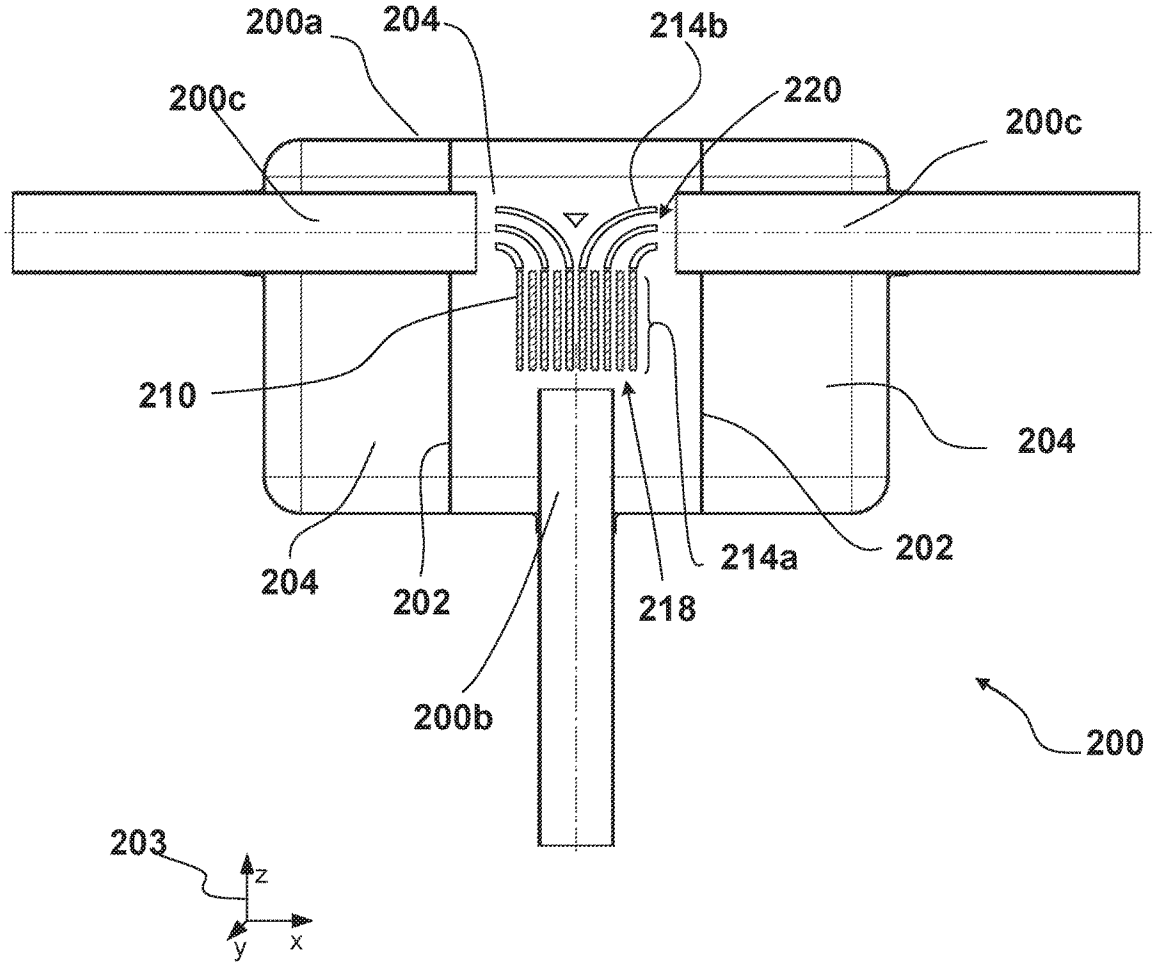
FIG. 7 is a top view of the exhaust silencer assembly, according to a further arrangement of the present disclosure.

The silencer is described below in more detail with reference to FIGS. 3 to 7. FIG. 3 shows a perspective view of the silencer 200. FIGS. 4 and 5 show cross-sectional views of the silencer 200. With reference to FIG. 4, the cross-section is taken at plane 302 as shown in FIG. 3. With reference to FIG. 5, the cross-section is taken at plane 304 as shown in FIG. 3. FIG. 6A is a top view of the silencer, FIG. 6B is a top view of the heat sink, and FIG. 7 is a top view of an alternate embodiment of the silencer. Axes 203 indicate the relative viewing angles shown in FIGS. 3 to 7. FIGS. 3-7 are described collectively below.

The silencer 200 may further comprise one or more baffle plates 202 provided within the housing 200*a*, which define one or more chambers 204, which are in fluidic communication with each other. In one embodiment, baffle plates 202 may be constructed of a material such as a metal or metal alloy, a composite material, or a polymer material. Baffle plates 202 may be of a gas-impermeable construction, or alternatively may be porous or perforated. Baffle plates 202 may be joined to or in contact with the walls of the silencer 200*a*, such that chambers 204 may be defined by the baffle plates 202 and walls of the silencer housing 200*a*. Chambers 204 may be completely or partially enclosed by baffle plates 202 and/or walls of silencer housing 200*a*, where slots, holes, or gas-permeable membranes in the defining walls of chambers 204 may restrict or permit a flow of gas. Chambers 204 may be in fluidic communication with other chambers of the silencer 200 or with a flow of exhaust passing therethrough. Chambers 204 may further comprise resonating chambers configured to produce pressure waves, which destructively interfere with the pressure variations within the exhaust gases, reducing the magnitude of the pressure variations. Additionally or alternatively, the chambers 204 may comprise one or more passages (not shown) comprising a sound deadening material, such as fiberglass, configured to dampen the pressure variations within the exhaust gases. The exhaust inlets and exhaust outlets may extend into one of the chambers 204, e.g. a central chamber.

Housing 200*a* may be rectangular prismatic in shape, with sharp or rounded corners or edge interfaces. Corners or edges of housing 200*a* may be rounded by a radius such as radius 260. Housing 200*a* may also be cylindrical or shaped as an elliptic cylinder. In some embodiments, housing 200*a* may have a complex prismatic shape, e.g. a box with contoured cutouts or molded notches or grooves, which may allow the positioning or nesting of silencer 200 with adjacent hardware, may provide structural strength, optimal heat distribution or dissipation, or may provide favorable or functional interior geometry for the arrangement of interior components such as exhaust inlets/outlets, heat sinks, mounting hardware, thermal masses, baffle plates, acoustic materials, or resonating chambers.

In order to reduce the temperature of exhaust gases in the silencer housing 200*a*, the silencer may comprise a heat sink 210. The heat sink 210 may be provided, or at least partially provided, within the housing. The heat sink 210 may be provided between the exhaust inlets 200*b* and the exhaust outlets 200*c*. In other words, the heat sink 210 may be provided within the flow path of exhaust gases flowing between the exhaust inlets 200*b* and the exhaust outlets 200*c*. Heat sink 210 may be constructed of a metal or metal alloy such as an aluminum alloy, a composite material, or another material of adequate thermal conductivity to collect and transmit heat from exhaust gases.

One or more tailpipes 110 may be coupled to one or more exhaust outlets 200*c*. Each tailpipe 110 may comprise a pipe, conduit, or passage which may convey a flow of exhaust gas from an exhaust outlet 200*c* to the atmosphere. Each tailpipe 110 may be constructed of a metal or metal alloy, a composite material, a polymer material. Each tailpipe 110 may be bonded to an exhaust outlet 200*c*, e.g. by a welded joint, or by a bonding method of lesser thermal durability, e.g. by an adhesive.

As depicted in FIGS. 3 to 7, the heat sink 210 may be spaced apart from the exhaust inlets 200*b* and the exhaust outlets 200*c*. However, it is equally envisaged that the heat sink 210 may be in contact with or connected to the exhaust inlets 200*b* and/or the exhaust outlets 200*c*.

The heat sink 210 may be coupled to the housing 200*a* of the silencer. The heat sink 210 may be coupled to the housing using any method that is suitable for coupling the material of the housing 200*a* with the material of the heat sink. For example, if the housing is made from a steel material, the heat sink may be welded or brazed to the housing. Alternatively, if the housing 200*a* is made from a composite or polymer material, the heat sink 210 may be bonded or mechanically coupled to the housing 200*a*. A seal may be provided between the housing 200*a* and the heat sink 210.

The heat sink 210 may extend along the y (vertical) axis from a first end 210*a* to a second end 210*b*. As shown in FIGS. 4 and 5, the heat sink 210 may comprise a first portion 212*a* and a second portion 212*b*. The first portion 212*a* may be provided between an outer wall of the housing 200*a* and a first end 210*a* of the heat sink. In other words, the first portion 212*a* of the heat sink may be provided inside the housing 200*a*. The first portion 212*a* of the heat sink may be arranged within a flow of exhaust gases within the housing 200*a*.

The heat sink 210 may extend beyond the outer wall of the housing 200*a*. For example, the second portion 212*b* may be provided between the outer wall of the housing 200*a* and a second end 210*b* of the heat sink. The second portion 212*b* of the heat sink may be provided within a flow of air passing over the housing 200*a*. The heat sink may thereby be configured to transfer heat from the exhaust gases within the housing to the air passing over the housing 200*a*, e.g. outside the housing 200*a*. Additional exterior portions of the heat sink 210, which may be in thermal communication with the first portion 212*a* or with an additional interior heat sink portion (not shown), may extend beyond one or more outer wall of the housing 200*a*. Thus, the silencer 200 may comprise a plurality of heat sinks, and/or may comprise a plurality of heat sink portions which extend beyond an outer wall or walls of the housing 200*a*, such that they may be in thermal contact with air outside the silencer 200.

The first end 210*a* of the heat sink may be spaced apart from the housing outer wall by a distance 250. In an alternative arrangement, the first end 210*a* may contact the outer wall, pass through the outer wall, and/or be thermally insulated from the outer wall. In examples where the first end 210*a* extends to the outer wall, a third portion of the heat sink may extend outside the housing where the first end 210*a* contacts the outer wall.

The first portion 212*a* of the heat sink may comprise a first array of fins 214 which extend in a first direction A from the first end 210*a* of the heat sink towards the outer wall of the housing.

As depicted in FIGS. 3 to 6B, the first array 214 may comprise a first region 214*a* and a second region 214*b*. The fins within the first region 214*a* may additionally extend in a second direction B, which is perpendicular to the first direction A. The fins in the first region may therefore form plates, which are provided on planes defined by the first and second directions A, B.

The fins within the first region 214*a* may form, e.g., at least partially form, one or more inlet flow channels 218. For example, the inlet flow channels 218 may be defined between adjacent fins. The fins within the first region may be provided such that the inlet flow channels 218 are configured to direct the flow of exhaust gases from an exhaust inlet 200*b* into the heat sink 210 in the direction of the exhaust flow, such that disturbances to the flow of exhaust gases due to the presence of the fins are minimized.

Heat sink 210 or components of heat sink 210 may extend in one or more third directions C. The third directions C may be perpendicular to the first direction A and may be at an angle to the second direction B. As depicted in the arrangement shown in FIGS. 3 to 6B, the third direction C is provided at 90°, e.g., perpendicular, to the second direction B. As further depicted in FIGS. 3 to 6B, fins within the first region 214*a* and/or second region 214*b* may be aligned side-by-side in the third direction C.

The fins within the second region 214*b* may form, e.g. at least partially form, one or more outlet flow channels 220. For example, the outlet flow channels 220 may be defined between adjacent fins, e.g. between adjacent pairs of fins. The fins within the second region 214*b* may be provided such that the outlet flow channels are configured to direct the flow of exhaust gases in the direction of the flow of exhaust gases passing through an exhaust outlet 200*c* of the silencer 200.

The fins within the first and second regions 214*a*, 214*b* may be configured such that one or more of the inlet flow channels 218 are in fluidic communication with one or more of the outlet flow channels 220. In the arrangement shown in FIGS. 3 to 6B, each of the inlet flow channels is in fluidic communication with each of the outlet flow channels. However, other arrangements are also envisaged. For example, in the arrangement shown in FIG. 7, each of the outlet flow channels is in fluidic communication with only two of the inlet flow channels.

As shown in FIGS. 3 to 6B, the fins within the second region 214*b* may form a 2-dimensional matrix of fins. In one embodiment, the fins within the second region 214*b* may comprise a matrix of rods, which may be cylindrical, rectangular prismatic, or of an irregular cross-sectional shape. In another embodiment, one or more fins of the second region 214*b* may extend in the third direction C, e.g. form a plane aligned in directions A and the third direction C. In some embodiments, the second region 214*b* may comprise a combination of one or more rods and one or more planar fins, at least some of which planar fins may extend in a third direction C. For example, the second region 214*b* may comprise a matrix of fins which are rods, and an additional planar fin which extends along third direction C, which planar fin may be placed in a position downstream of the rods to act as a back-piece, redirecting exhaust flow in the third direction C.

In order for each of the inlet channels 218 to be in fluidic communication with each of the outlet channels 220, at least some of the fins within the second region 214*b* may be segmented, e.g., they may be discontinuous in the third direction C. For example, a planar fin extending in direction C may be discontinuous in the direction C by having holes, perforations, slots, voids, or spaces, which may allow fluid communication across the plane of the fin.

Configuring the fins within the second region 214*b* in this way may allow exhaust gases to diffuse out of the heat sink 210 in multiple directions, which may reduce the disruption caused by the heat sink 210 to the exhaust flow. Additionally, providing fins which are rods, and/or discontinuous in the third direction C, may increase a surface area of the heat sink which is exposed to hot exhaust gases, which may increase heat transfer from the exhaust gases into the heat sink 210.

In some embodiments, channels through one or more regions of the interior portion of heat sink 210, e.g., inlet channels 218 and/or outlet channels 220, may be defined at least partially by heat sink fins, and may be further defined by walls of the housing 200*a*, baffle plates 202, or by alternative interior structures of silencer 200. The channels may at least partially direct the flow of exhaust gas. In some embodiments, the channels may disrupt or diffuse gas flow, or may direct gas flow through extended heat sink structure, e.g., to impart further cooling, and/or contribute to a streamlined gas flow through silencer 200, e.g., for reduced backpressure.

With reference to FIGS. 4 and 5, the second portion 212*b* of the heat sink may comprise a second array of fins 216. The fins within the second array may extend in a fourth direction D from the second end 210*b* of the heat sink towards the housing 200*a*. As shown in FIG. 4, the fourth direction D may substantially aligned with (e.g., parallel to) the first direction A, however, it is also envisaged that the fourth direction D may be defined at an angle relative to the first direction A. Fourth direction D may further be perpendicular or at an angle relative to the outer surface of the silencer housing 200*a*.

The fins within the second array 216 may extend in a fifth direction E, e.g., the fins within the second array may form plates in a plane defined by the fourth and fifth directions D, E. The fifth direction E may be perpendicular to the fourth direction D. As depicted, the fifth direction E may substantially aligned with (e.g., parallel to) the second direction B, however, it is also envisaged that the fifth direction E may be defined at an angle relative to the second direction B. In another embodiment, the fins within the second array 216 may form a 2-dimensional matrix of fins. The fins within the second array 216 may comprise rods, which may be cylindrical, rectangular prismatic, or of an irregular cross-sectional shape.

The fins within the second array may form, e.g. at least partially form, one or more external flow channels 222. The fifth direction E may be substantially aligned with a flow of gas passing over the housing 200*a*. The external flow channels 222 may therefore be configured to receive a flow of air passing over the silencer wall. In one embodiment, air passing over the housing 200*a* may be airflow around a moving vehicle comprising silencer 200. In another embodiment, air may be directed mechanically over the exterior of the housing 200*a* and/or the second array of fins 216, e.g., by a fan. The direction of the external flow of gas over the housing 200*a* may vary during operation of the vehicle, hence the fifth direction E may be substantially aligned with a prevailing direction of the external flow.

In the arrangement shown in FIGS. 3 to 6B, the fins within the second array 216 are continuous in the fifth direction E. However, it is equally envisaged that the fins within the second array 216 may be segmented, e.g., discontinuous, in the fifth direction E. The fins within the second array 216 may form a 2-dimensional array of fins, which may be substantially rod shaped, similar to the fins provided within the second region 214*b* of the first array. Configuring the fins to be discontinuous in the fifth direction may allow a flow of air within the external flow channels when the flow over the silencer housing 200*a* has deviated from the prevailing direction.

With reference to FIG. 6B, the heat sink 210 may comprise the first region 214*a*. In one embodiment, the fins of first region 214*a* may be planar or rectangular prismatic. The edges of the fins of first region 214*a* may be rounded or cornered on one or more edges. In another embodiment, the fins of first region 214*a* may be rods or posts. In some embodiments, rod or post-shaped fins may be cylindrical or rectangular prismatic. In one embodiment, first region 214*a* may comprise ten fins. In other embodiments, first region 214*a* may comprise more or fewer than ten fins. Heat sink 210 may further comprise second region 214*b*. In some embodiments, the fins of second region 214*b* may be rods or posts, where the rods or posts may be cylindrical or rectangular prismatic. The second region 214*b* may comprise a rectangular matrix featuring rows and columns of rod-shaped fins. In one embodiment, second region 214*b* may comprise seven rows and ten columns of fins. In other embodiments, second region 214*b* may have more or fewer columns and/or rows of fins. In some embodiments, second region 214*b* may comprise an arrangement of fins that is not a rectangular matrix of fins. In some of these embodiments, the fins may be rods or posts. For example, second region 214*b* may comprise rods arranged in staggered or offset patterns, wherein the fins are not linearly aligned with one another. In other arrangements, the number of fins in one row or column may be different from the number of fins in other rows and/or columns.

The fins of first region 214*a* may have a width 310 and a length 312. In one embodiment, each fin of first region 214*a* may have the same width 310. In other examples, the widths 310 of the fins may be different from one another. In one example, the fins at the center of first region 214*a* may be thicker or thinner than the fins at the outer sides of first region 214*a*, e.g., to optimize heat transfer from the exhaust gas, or to optimize heat distribution in heat sink 210. In one embodiment, the fins may have equal lengths 312. In a different example, fins may have lengths which are different from one another. Similarly, fins of the second region 214*b* may have a width 320 and a length 322. In one embodiment, the width 320 and length 322 may be the same. In other examples, the width 320 may be less than or greater than width 322. In one embodiment, the fins of the second region 214*b* may each have a uniform width 320. In other embodiments, fins may have different widths. Likewise, the length 322 may be uniform or different amongst the fins of the second region 214*b*. In some embodiments, the width 320 and/or length 322 may be equal to or similar to the width 310. In further embodiments, the width 320 and/or length 322 may be greater than or less than width 310. For example, the first region 214*a* may comprise plate-shaped fins and the second region 214*b* may comprise pin-shaped fins, wherein the width 310 of the plate-shaped fins may exceed the width 320 of the pin-shaped fins by several times the width 320, for instance five times the width 320.

The fins of the first region 214*a* may define one or more inlet flow channels 218, which may have a width 330. In one embodiment, the inlet flow channels 218 may all have a uniform width 330. In other embodiments, different inlet flow channels 218 may have different widths 330. For example, the centrally-located flow channels 218 may be wider than the flow channels 218 at the outer sides of the first region 214*a*, e.g. to facilitate a higher volume of gas flow at the center. The fins of the second region 214*b* may define one or more outlet flow channels 220, which may have a width 332. In one embodiment, the width 332 may be uniform for all flow channels 220. In other embodiments, individual flow channels 220 may have different widths 332. In further embodiments, an individual flow channel may not have a uniform width throughout. For example, in an arrangement where the fins of second region 214*b* are aligned in a staggered or irregular pattern, the width of a flow channel 220 may vary at different points along the length of the flow channel. In one embodiment, the width 332 may be equal to the width 330, such that the flow channels of the first region 214*a* and the second region 214*b* are substantially similar in width. In other embodiments, the flow channels 220 may be wider or narrower than flow channels 218.

In one embodiment, heat sink 210 and/or first region 214*a* may have an overall width 340. Second region 214*b* may also have an overall width 340, or in another embodiment, second region 214*b* may have a width that is greater than or less than first region 214*a*. In a further embodiment, the width of first region 214*a* and/or second region 214*b* may not be uniform throughout. For example, region 214*b* may comprise some rows of 10 fins, and some rows of eleven fins, in a staggered pattern, such that the width of region 214*b* is not uniform along its length.

Pathways 350 show possible paths of a flow of exhaust gases. Exhaust gases may enter the inlet flow channels 218 in the first region 214*a*, and may be directed toward the outlet flow channels 220, which may run in the B or C directions. Exhaust gases may flow through and exit from a plurality of outlet flow channels 220. In one embodiment, exhaust gases may follow a path as indicated by the flow paths 350. In other embodiments, exhaust gases may follow alternative flow paths through inlet channels 218 and outlet channels 220. In one embodiment, gases may follow a streamlined and/or laminar flow path through flow channels 218 and 220. In another embodiment, gases may follow a turbulent flow path through flow channels 218 and/or 220.

By providing the first and second arrays of fins 214, 216, as described above, heat may be absorbed from the exhaust gases within the housing 200*a* and transferred to the external flow of air passing over the outside of the housing 200*a*, without being transferred through the housing. Transferring heat from the exhaust gases within the housing 200*a* to the flow of air passing over the outside of the housing 200*a* may cool the exhaust gases within the housing 200*a*, which may reduce the transfer of heat from the exhaust gases to the housing. As a result, the housing may be formed from a composite or polymer material as a result of the lower temperatures. The weight of the silencer may thus be reduced.

To further reduce the amount of heat being transferred to the housing 200*a*, the heat sink 210 may be thermally insulated from the housing 200*a*, e.g., by virtue of a thermally insulating seal 270 provided around the heat sink at the interface with the housing. The heat sink may therefore bypass the housing 200*a* when transferring heat across the outer wall of the housing.

The heat sink 210 may comprise an intermediate portion, such as a thermal mass 224. The thermal mass 224 may be constructed of a metal or metal alloy, a composite material, or an alternative material of suitable thermal conductivity to transmit heat from a heat sink first portion to a heat sink second portion, e.g., from first portion 212*a* to second portion 212*b*.

Thermal mass 224 may be a slab or plurality of slabs, coupled to or inset in an outer wall of the housing 200*a*, and further coupled to or in contact with first portion 212*a* and/or second portion 212*b*. The intermediate portion may be provided between the first and second portions of the heat sink 210. In some embodiments, the intermediate portion may be a part of heat sink 210, wherein the intermediate portion is a single piece with the first portion 212*a* and/or the second portion 212*b* of the heat sink 210. The first and second arrays of fins may be connected to opposite sides of the intermediate portion. The heat sink may be coupled to the housing 200*a* at the intermediate portion. The intermediate portion may form a barrier preventing flow of gases between the first and second heat sink portions 212*a*, 212*b*.

The intermediate portion may provide a thermal mass that may absorb a large amount of heat without greatly increasing in temperature, compared to other portions of the heat sink 210 and housing 200*a*. The heat sink may therefore prevent or absorb fluctuations in the temperature of the exhaust gases from affecting the amount of heat transferred to the housing 200*a*.

In addition to reducing the amount of heat transferred from the exhaust gases to the housing 200*a*, providing the heat sink 210 within the silencer 200 may reduce the temperature of exhaust gases leaving the silencer 200. As depicted in FIG. 2, this may allow the low temperature tail pipes 110 to be used within the exhaust assembly 100.

The low temperature tail pipes 110 may be constructed from a lighter material than the tail pipes 10, such as a composite or polymer material or a lightweight metal, and may be coupled to the silencer 200 using a low temperature coupling method, such as a structural adhesive, which may be quicker and/or cheaper than the method used to couple the tail pipes 10 to the silencer 8.

With reference to the embodiment depicted in FIG. 7, the fins within the second region may be profiled, e.g. curved. The fins within the second region may be configured to direct the exhaust gases from the inlet flow channels 218 towards the exhaust outlets 200*c*. Profiling the fins within the first and/or second regions of the first array of fins may reduce the disruption caused by the heat sink 210 to the exhaust flow.

The silencer 200 of the present disclosure may also withstand higher temperature exhaust gases, which may provide an increased durability of the exhaust system at elevated exhaust temperatures. This increased durability may permit the use of higher-temperature exhaust for the warming of the catalytic converter 6, which may reduce the time that the catalytic converter 6 takes to reach the light-off temperature.

It will be appreciated that the configurations and routines disclosed herein are exemplary in nature, and that these specific embodiments are not to be considered in a limiting sense, because numerous variations are possible. For example, the above technology can be applied to V-6, V-4, V-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An exhaust silencer, comprising:

a housing defining an exhaust inlet and an exhaust outlet;

one or more noise reducing chambers provided within the housing; and a heat sink configured to transfer heat from exhaust gases to outside the housing of the exhaust silencer, a first portion of the heat sink including planar fins oriented perpendicular to the exhaust inlet or the exhaust outlet and arranged in a flow of exhaust gases and on a center axis of the exhaust inlet, a second portion of the heat sink extending beyond an outer wall of the housing.

2. The exhaust silencer of claim 1, wherein the first portion of the heat sink comprises one or more inlet flow channels arranged downstream of the exhaust inlet, the inlet flow channels configured to at least initially direct flow in a direction of incoming exhaust from the exhaust inlet.

3. The exhaust silencer of claim 2, wherein the first portion of the heat sink comprises one or more outlet flow channels arranged upstream of the exhaust outlet, the outlet flow channels configured to direct flow in a direction of exhaust passing through the exhaust outlet, and wherein the one or more inlet flow channels are in fluidic communication with one or more of the one or more outlet flow channels.

4. The exhaust silencer of claim 1, wherein the planar fins comprise a first array of fins, wherein the first array of fins extends in a first direction from a first end of the heat sink towards the outer wall of the housing.

5. The exhaust silencer of claim 4, wherein the first array of fins is configured to direct flow of exhaust gases from the exhaust inlet of the exhaust silencer to the exhaust outlet of the exhaust silencer.

6. The exhaust silencer of claim 4, wherein the first array of fins extends in one or more second directions, which are perpendicular to the first direction.

7. The exhaust silencer of claim 1, wherein the second portion of the heat sink comprises a second array of fins, wherein fins within the second array of fins extend in a fourth direction from a second end of the heat sink towards the outer wall of the housing.

8. The exhaust silencer of claim 7, wherein the fins within the second array of fins at least partially define external flow channels.

9. The exhaust silencer of claim 7, wherein the fins within the second array of fins extend in a fifth direction, perpendicular to the fourth direction, wherein the fifth direction is aligned with a prevailing flow of air passing over the housing of the exhaust silencer.

10. The exhaust silencer of claim 1, wherein the heat sink is thermally insulated from the housing of the exhaust silencer.

11. The exhaust silencer of claim 1, wherein the housing of the exhaust silencer and one or more tailpipes are constructed from at least one of a metal, a metal alloy, a composite material, and a polymer material.

12. The exhaust silencer of claim 1, wherein the heat sink further comprises a thermal mass provided between the first and second portions of the heat sink, and wherein the heat sink is coupled to the housing of the exhaust silencer at the thermal mass.

13. An exhaust system or vehicle comprising the exhaust silencer according to claim 1.

14. The exhaust silencer of claim 1, wherein the planar fins include a first and second array of fins and the second array of fins is arranged on the center axis of the exhaust inlet and a center axis of the exhaust outlet.

15. The exhaust silencer of claim 1, wherein the planar fins include a first and second array of fins and the second array of fins has a curved shape.

16. The exhaust silencer of claim 1, wherein the center axis of the exhaust inlet and a center axis of the exhaust outlet are perpendicular.

17. An exhaust silencer including a heat sink, comprising:

one or more noise reducing chambers provided within a housing; and a first portion of the heat sink including a first array of fins positioned in a flow of exhaust gases and on a center axis of an exhaust inlet within a first chamber of the one or more noise reducing chambers, a second portion of the heat sink extending beyond an outer wall of the housing;

wherein the first array of fins extends in a first direction towards the outer wall and comprises a first region and a second region;

wherein fins within the first region extend in one or more second directions, which are perpendicular to the first direction; and wherein fins within the second region extend in one or more third directions, which are perpendicular to the first direction and are at an angle to at least one of the one or more second directions.

18. The exhaust silencer of claim 17, wherein the fins within the first region at least partially define inlet flow channels, the fins within the second region at least partially define outlet flow channels, or fins in both the first and second regions at least partially define the outlet flow channels.

19. The exhaust silencer of claim 17, wherein the fins within the second region are discontinuous in the one or more third directions.

20. An exhaust silencer, comprising:

a housing including an exhaust inlet and one or more exhaust outlets;

a plurality of noise-reducing chambers within the housing; and a heat sink positioned in one of the plurality of noise-reducing chambers and extending from within the housing to beyond an outer wall of the housing, the heat sink comprising a first set of plate-shaped fins arranged parallel to and on a center axis of the exhaust inlet and a second set of rod-shaped fins arranged parallel to and on the center axis of the exhaust inlet and parallel to an exhaust outlet flow direction.

21. The exhaust silencer of claim 20, wherein the first set of plate-shaped fins and the second set of rod-shaped fins are positioned within the housing, and wherein the heat sink comprises a third set of plate-shaped fins positioned outside the housing, the first set of plate-shaped fins thermally coupled to the third set of plate-shaped fins via a thermal mass.

* * * * *